United States Patent [19]

Ikeda et al.

[11] 4,334,842

[45] Jun. 15, 1982

[54] ROTARY PUMP WITH RADIAL YIELDABLE PARTITIONS AND ROTATABLE SIDE PLATE

[76] Inventors: Yoshi Ikeda, No. 3-3-17, Sekimae, Musashino-shi, Tokyo; Kenji Osada, No. 3-7-15, Asagaya-Minami, Suginami-ku, Tokyo; Kazumi Doi, No. 2-14-21-203, Mure, Mitaka-shi, Tokyo, all of Japan

[21] Appl. No.: 8,506

[22] Filed: Feb. 1, 1979

Related U.S. Application Data

[60] Continuation of Ser. No. 730,303, Oct. 7, 1976, abandoned, which is a division of Ser. No. 464,926, Apr. 29, 1974, Pat. No. 4,004,865.

[30] Foreign Application Priority Data

| | | | |
|---|---|---|---|
| May 1, 1973 | [JP] | Japan | 48-49511 |
| Nov. 16, 1973 | [JP] | Japan | 48-129061 |
| Dec. 3, 1973 | [JP] | Japan | 48-135960 |
| Feb. 13, 1974 | [JP] | Japan | 49-17924 |

[51] Int. Cl.[3] ..... F04C 5/00; F04C 15/02

[52] U.S. Cl. ..... 418/45; 418/153

[58] Field of Search ..... 418/45, 153, 154, 156; 417/478

[56] References Cited

U.S. PATENT DOCUMENTS

| | | | |
|---|---|---|---|
| 631,701 | 8/1899 | Du Bois | 418/156 |
| 2,293,268 | 8/1942 | Quiroz | 418/154 |
| 2,336,580 | 12/1943 | Yeatman | 418/154 |
| 2,882,830 | 4/1959 | McDuffie | 418/154 |
| 3,881,846 | 5/1975 | Kashmerick | 417/478 |

FOREIGN PATENT DOCUMENTS

| | | | |
|---|---|---|---|
| 1910436 | 9/1970 | Fed. Rep. of Germany | 417/478 |

*Primary Examiner*—John J. Vrablik

[57] ABSTRACT

A volume pump which comprises a cylindrical pump chamber including therein a plurality of compartments which are radially formed with flexible partitions and side plates adapted to close opposite open sides of the pump chamber, suction and delivery means arranged in relation to the pump chamber and a deflection means disposed at a center of the pump chamber to successively compress each compartment.

4 Claims, 37 Drawing Figures

FIG.24
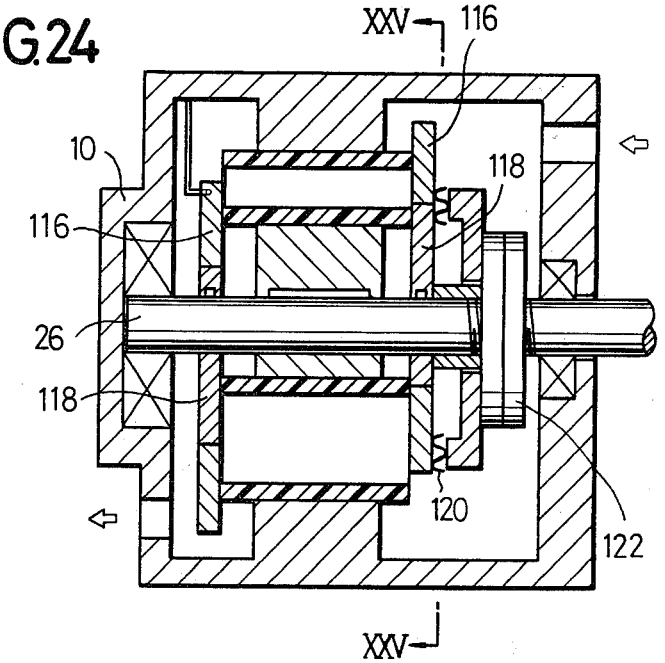
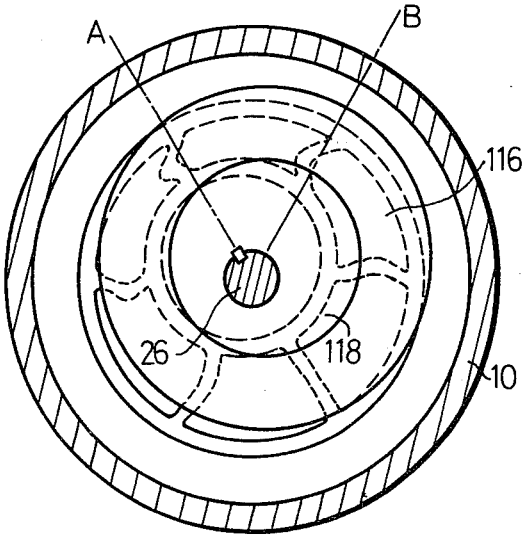
FIG.25
FIG.26
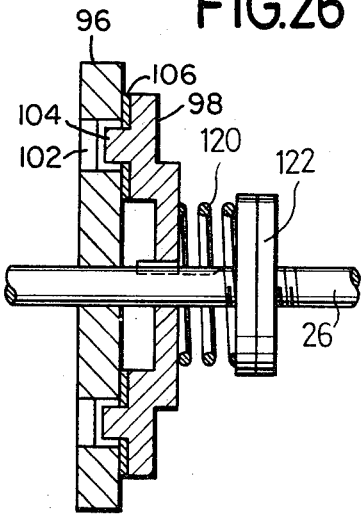

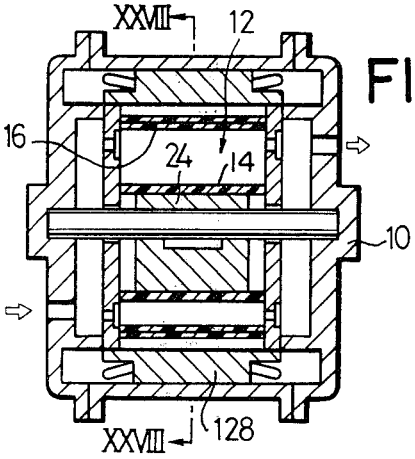
FIG.27
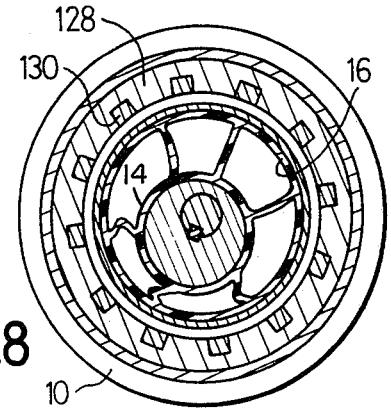
FIG.28
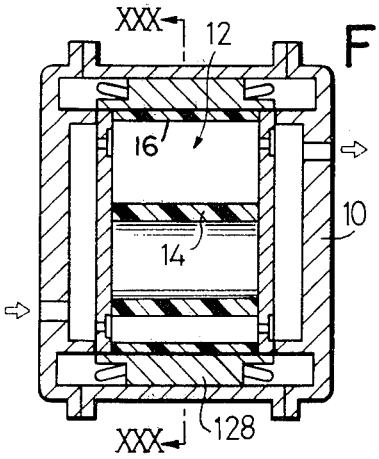
FIG.29
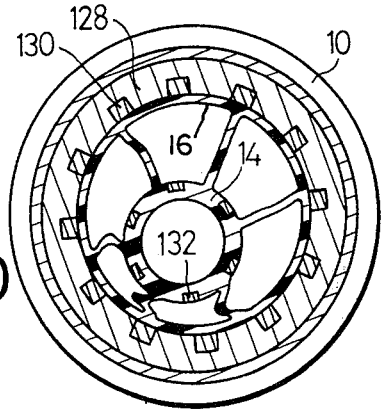
FIG.30
FIG.31
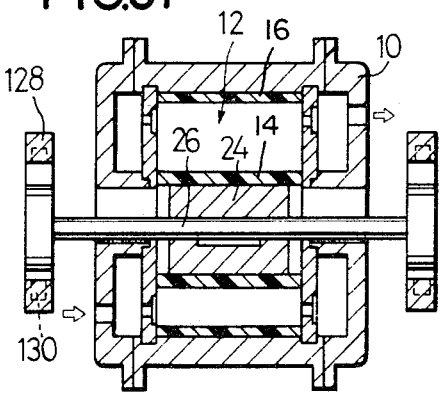
FIG.32
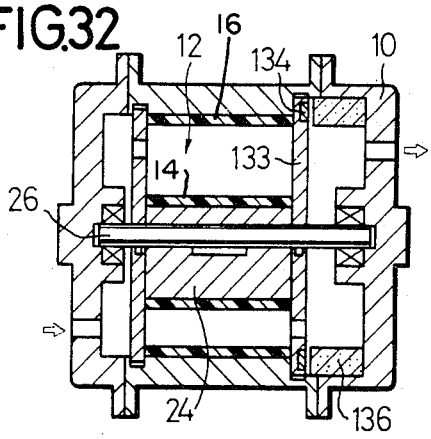

ROTARY PUMP WITH RADIAL YIELDABLE PARTITIONS AND ROTATABLE SIDE PLATE

This is a continuation application of Ser. No. 730,303, filed Oct. 7, 1976, now abandoned which itself is a divisional application of Ser. No. 464,926, filed Apr. 29, 1974, now U.S. Pat. No. 4,004,865, issued Jan. 25, 1977.

BACKGROUND OF THE INVENTION

This invention relates to an improved volume pump having a plurality of pump chambers.

The rotary pump heretofore used contains a flexible impeller and operates at a high delivery rate with a sufficient self-suction as well as lifting properties despite its compact structure, nevertheless requires a high motive power and produces undesired noise during the operation, for which reason the conventional rotary pump is unsuited for hospital or house hold use. Further, in the conventional rotary pump, the impeller is usually worked under the severe environments and likely subjected to abrassion and damage within a relatively short time, so that the necessity arises of frequently replacing the impeller by a fresh one with resulting inconvenience, poor economy and increased cost. Moreover, the material of which the impeller may be made is restricted and the impeller material being selected to be resistive to chemicals and heat may not have sufficient mechanical strength.

To improve the foregoing disadvantages and difficulties, the inventors have invented after extensive researches an improved volume pump in which the outer edges of the vanes are shrouded with a sleeve to form a plurality of the compartments in the pump chamber which at its center is provided with a deflection means and closed at its opposite open sides by side plates and also provided with a suction and delivery means where the deflection means is actuated to compress each compartment of the pump chamber successively thereby to achieve the pumping action with a variation of volume of each compartment.

SUMMARY OF THE INVENTION

It is, therefore, a general object of the present invention to provide a novel volume pump which operates with negligible noise and improved durability.

A principal object of the invention is to provide a volume pump means comprising a cylindrical pump chamber which includes a plurality of compartments radially formed with flexible partitions and side plates adapted to close opposite open sides thereof, a suction and delivery means provided in relation to the pump chamber and a deflection means arranged at a center of the pump chamber to successively compress each compartment.

The pump chamber in accordance with the present invention is generally formed integrally and comprises an internal sleeve and an external sleeve concentrically arranged between which a plurality of flexible partitions are integrally or detachably bridged to provide a plurality of compartments and side plates adapted to cover opposite open sides of the pump chamber. Individual partition may consist of hard material and intermediately hinged to provide a flexibility. The pump chamber may be formed by assembling a plurality of pump chamber components. In this example, individual chamber component comprises a first curved segment and a second curved segment having a larger curvature than that of the first segment and these curved segments are integrally or releasably bridged by one or more flexible partition. Such assembly of the pump chamber facilitates the manufacture of the pump chamber and also a part of the pump chamber when damaged may readily be repaired by merely substituting the damaged component with the fresh one.

The pump chamber in accordance with the present invention may be selectively provided with stationary side plates or rotary side plates as hereinafter fully described. The stationary side plates are provided with a suction means on one side and with a delivery means on the other side so that the fluid is supplied from the suction port into the volume variable compartment and delivered from the outlet thereof.

The suction means and the delivery means typically comprise a check valve which includes a flap valve, a ball valve, a conical valve, a disc valve, a tube valve, an umbrella valve, a ring valve and the like.

The check valve particularly designed for the present invention comprises a valve seat which has a port of predetermined size and a valve body adapted to sit on the valve seat. The valve body is resiliently supported by an elastic connection formed integrally or detachably with the valve body. The valve of this structure is not limitative in relation to the shape of the valve seat and may be mounted in any place even, for example, on the curved portion which has been considered difficult for placement of the valve. Alternately, the check valve may comprise a supporting sleeve encompassing and secured to the external sleeve of the pump chamber and provided with one or more ports, a valve body adapted to cover the ports. The valve body is resiliently mounted on the support sleeve through one or more elastic connections formed integrally or releasably with the valve body.

The side plates for covering opposite open sides of the pump chamber are detachably engaged with the pump chamber under action of a magnetic field or a spring so that when an abnormal pressure is developed in the compartment of the pump chamber, the stationary side plates are displaced in resistance to the magnetic force or the spring force and the pressure in the compartment is quickly released for security.

When the rotations of the pump driving shaft is greatly increased, for example, over 1,000 r.p.m., cyclic operation of the valve provided in the stationary side plates becomes difficult because of the rapidity with which valve operation must be performed at increased speed of pump shaft rotation. One way of avoiding the foregoing drawback is to mount side plates rotatably to the pump chamber and to provide openings in the rotary side plates of a shape and size sufficient to suck or deliver the fluid into or from the compartment of the pump chamber as a function of volume variation of the compartment. On variation of the volume of the compartment, an inactive zone as shown in FIG. 12 with oblique lines is inevitably generated due to the flexibility and thickness of the partition. In the theoretical consideration of the volume change of each compartment to be caused by movement of the deflection means, it is sufficient to select and part of the area in which the volume change takes place, excepting for the area of the inactive zone as hereinbefore defined. For example, it is sufficient to determine the volume change to be generated between the periphery of the inner sleeve A and the circle B to be formed by a track of an eccentric circulation of the periphery of the inner sleeve A. An area ΔS to be formed between the periphery A and the circle B may be defined by the following formula:

$$\Delta S = \tfrac{1}{2}\,\overline{OP} \times \overline{OQ} \times \Delta\theta - \tfrac{1}{2}\,\overline{OP_1} \times \overline{OQ_1} \times \Delta\theta$$

Consequently, an area S at the predetermined angle ($\theta_1$-$\theta_2$) may be obtained by integrating the aforementioned ΔS as follows:

$$S = \tfrac{1}{2}\left[R^2\theta - \tfrac{1}{2}\left\{1^2 \sin 2^\theta + r^2\theta + 2r1 \sin\theta - \frac{1^3}{2r}\left(\tfrac{1}{2}\sin\theta - \frac{1}{6}\sin 3\theta\right)\right\}\right]_{\theta_1}^{\theta_2}$$

The volume change of each compartment may be obtained, for example, by dividing the chamber into six compartments by means of partitions as best shown in FIGS. 14 and 15 and calculating the volume change of the individual compartment which take places by the variation of the phase angle of the deflection means disposed at the center of the chamber.

FIG. 14 is a schematic illustration of the manner in which fluid is delivered. Thus, FIG. 14*a* represents the state during which compartment volume variation commences. FIG. 14*b* shows the variation of the sectional area of the compartment when the deflection means is deflected at 1/16 phase angle, FIGS. 14*c*, 14*d* and 14*e* respectively variations of the sectional area of the compartments when the compartments are compressed due to the successive deflections of the deflection means at 1/6 phase angles. Providing R=29 mm, r=25 mm and i=4 mm, the changed areas Sb, Sc, Sd, and Se in FIGS. 14*b*, 14*c*, 14*d* and 14*e* may be calculated as follows:

Sb=13 $mm^2$
Sc=76 $mm^2$
Sd=97 $mm^2$
Se=23 $mm^2$

From the foregoing results of calculations, it is apparent that the considerable changes of the sectional areas of the compartments are generated during the transition from the position in FIG. 14*b* to the position in FIG. 14*c*, from the position in FIG. 14*c* to the position in FIG. 14*d* and from the position in FIG. 14*d* to the position in FIG. 14*e*.

It will be appreciated that the deflection means in FIGS. 14*b* and 15*e* and FIGS. 14*e* and 15*b* are positioned in the same phase so that the suction and delivery of the fluid take place simultaneously in an amount in proportion to the change of volume of each compartment. In the theoretical pump as shown in FIG. 12, an inactive zone is formed outside the circle B so that the compartments in the changed positions as shown in FIGS. 14*b* and 15*e* as well as 15*e* and 15*b* are considered as so called "dead" portions where no suction and delivery action takes place.

The suction and delivery operations of the pump take place only when the deflection means is positioned at the phase angle as shown in FIGS. 14*c* and 14*d* as well as in FIGS. 15*c* and 15*d*.

From the foregoing facts it has been confirmed that a sufficient pumping action may be exhibited by providing one of the rotary side plates of the pump chamber with a fluid suction port in the position corresponding to the compartment adjacent in the reversed turning direction of the deflection means to the compartment which is most compressed by the deflection means and the opposite rotary side plate with a fluid delivery port in the position corresponding to the compartment adjacent in the reversed turning direction of the deflection means to the compartment which is most enlarged by the deflection means.

When the pump chamber includes six compartments radially arranged, it is preferable to provide the rotary side plates with suction and delivery ports which extend over two compartments. As hereinbefore described, the size and shape of the suction port to be provided in the side plate is preferably determined in accordance with the calculated volume changes as hereinbefore defined so that the size of the port is decreased by slow degree in relation to the delayed change of the phase angle of the deflection means counting from the most compressed compartment. While, the size and shape of the delivery port to be provided in the opposite side plate are preferably determined in accordance with the calculated change of the volume as hereinbefore described so that the size is enlarged by slow degree in relation to the delayed change of the phase angle of the deflection means counting from the most enlarged compartment.

The suction port and the delivery port are preferably so provided in the opposite rotary side plates that the most sucked position and the most delivered position are located in symmetrical relation across the line which passes through the most compressed compartment and the most enlarged compartment. Thus an improved pump efficiency may be obtained.

It is therefore another aspect of the present invention to provide a volume pump means in which the pump chamber includes two rotary side plates for covering opposite open sides of the pump chamber and provided in the symmetrical positions with ports each of which has a size variable in accordance with variation of volume of the compartment to be caused by changes of the phase angle of the deflection means for obtaining a predetermined flow rate.

Further studies exercised for the determination of the positions of the ports to be provided in the rotary side plates in relation to several pump chambers which are equally divided into four, five, seven, eight and the like have traced the fact that for the pump chamber divided into even number the port is preferably positioned over the compartment of (n−2)/2 whereas for the pump chamber divided into uneven number the port is preferably positioned over the compartment of (n−1)/2.

It is, therefore, a further aspect of the invention to provide a volume pump in which the rotary side plates for covering the opposite open sides of the pump chamber including a plurality ("n" number) of the compartments are provided respectively with the ports which extend over the compartments of (n−2)/2 or (n−1)/2.

The port may be divided into a plurality of openings of different sizes.

On account of the prolonged operation of the pump, the rotary side plates in engagement with the marginal edges of the pump chamber are likely subjected to abrasion with undesired leakage of the liquid and loss of the pump efficiency. A further improvement, therefore, has been directed to provide a volume pump chamber which includes two stationary side plates placed on the opposite open sides of the pump chamber and provided with a plurality of ports at the positions corresponding respectively to each compartment of the pump chamber and two rotary side plates faced respectively with the external surfaces of the stationary side plates through the sealing members and provided respectively in the symmetrical positions with recesses for opening on rotation the ports provided in the stationary side plate. Alternately, the side plate may comprise a stationary annular plate and a rotary circular plate disposed in the same plane as the annular plate and engaged therewith through a rotary sealing member which is secured to the peripheral edge of the rotary circular plate and also provided with a recess for successively opening on rotation the compartment of the pump chamber. The side plates of this structure are mounted on opposite sides of the pump chamber so that the recesses provided in two sealing members may be positioned in a symmetrical relation.

Further, the stationary side plates may be secured to the deflection means which supports the driving shaft to obtain symmetrical deflections of the stationary side plates for effecting a successive openings of the compartments.

The rotary side plate on the suction side is mounted to a driving shaft through a slide key and the external surface thereof is resiliently supported by a stopper such as an adjusting nut through a spring mounted on the shaft so that when an abnormal pressure is generated in the compartment the rotary side plate is displaced resistive to the spring force to release the pressure for security.

Moreover, the pump chamber may be mounted with at its one open side with the stationary side plate provided with a valve means and its opposite open side with a rotary side plate of the structure as hereinbefore described.

A deflection means in accordance with the present invention may typically comprise a stationary type and a driven type which comprises a bearing secured to the internal sleeve, an eccentric cam which is beared by the bearing and a driving shaft for holding the eccentric cam and the driving shaft is driven to actuate the eccentric cam for successively compressing the compartments of the pump chamber. It will be appreciated that the eccentric cam of the stationary type does not require the driving motor. For example, an external sleeve of the pump chamber is formed of magnetic substances, for example, hysteresis magnet steel and an alternating field generator including a plurality of magnetic poles arranged radially with a predetermined distance is provided to encircle the external sleeve. When a predetermined voltage is applied to the generator, the outer sleeve encircles around the eccentric cam. Alternately, an internal sleeve is incorporated therein a desired number of magnetic substances and an alternating field generator including a plurality of radially arranged magnetic poles diposed around the internal sleeve for deflection thereof under the function of the magnetic field. Further, one end of the driving shaft supporting the eccentric cam may be outwardly extended to enter into the alternating field generator which includes a plurality of radially arranged magnetic poles to deflect the driving shaft. Moreover, one end of the driving shaft supporting the eccentric cam may be connected to the plates incorporated with magnetic substances and the alternating field generator which includes a plurality of the radially arranged magnetic poles is disposed in relating to the side plates for turning the side plates together with the eccentric cam under the influence of the magnetic field. The eccentric cam may be incorporated with magnetic substances and an alternating field generator which includes a plurality of radially arranged magnetic poles is provided in relation to the eccentric cam for deflection thereof under the influence of the magnetic field. A plurality of the deflection means as hereinbefore described may be mounted on a common shaft and individual deflection means is associated with the pump chamber of the same and/or different types as hereinbefore described to provide a multistage pumping system.

Other objects and advantages of the present invention will become apparent as the detailed description thereof proceeds.

For a fuller understanding of the present invention reference should now be had to the following detailed description thereof taken in conjunction with the accompanying drawings, wherein:

BRIEF DESCRIPTION OF THE DRAWINGS

FIG. 12 is a pictorial view showing a theoritical volume change of the pump chamber;

FIG. 24 is a longitudinally sectioned view of the volume pump of a further embodiment according to the invention;

FIG. 25 is a cross sectional view taken along the line XXV—XXV of FIG. 24;

FIG. 26 is a sectional view of the abnormal pressure release device for the volume pump according to the invention;

FIG. 27 is a longitudinally sectioned view of the pump where the internal sleeve is deflected under the influence of the magnetic field for the pumping operation;

FIG. 28 is a cross section taken along the line XXVIII—XXVIII of FIG. 27;

FIG. 29 is a longitudinally sectioned view of the pump where the internal sleeve is buried with magnetic substances and an alternating field generator is arranged therearound;

FIG. 30 is a cross sectional view taken along the line XXX—XXX of FIG. 29;

FIG. 31 is a longitudinally sectioned view of the pump where the driving shaft for supporting the eccentric cam is extended into the alternating field generator for deflection of the shaft together with the eccentric cam to effect the pumping operation;

FIG. 32 is a longitudinally sectioned view of the pump where the terminals of the driving shaft are secured to the side plates buried with magnetic substances which are turned under the influence of the magnetic field;

PREFERRED EMBODIMENTS OF THE INVENTION

Figure 1:
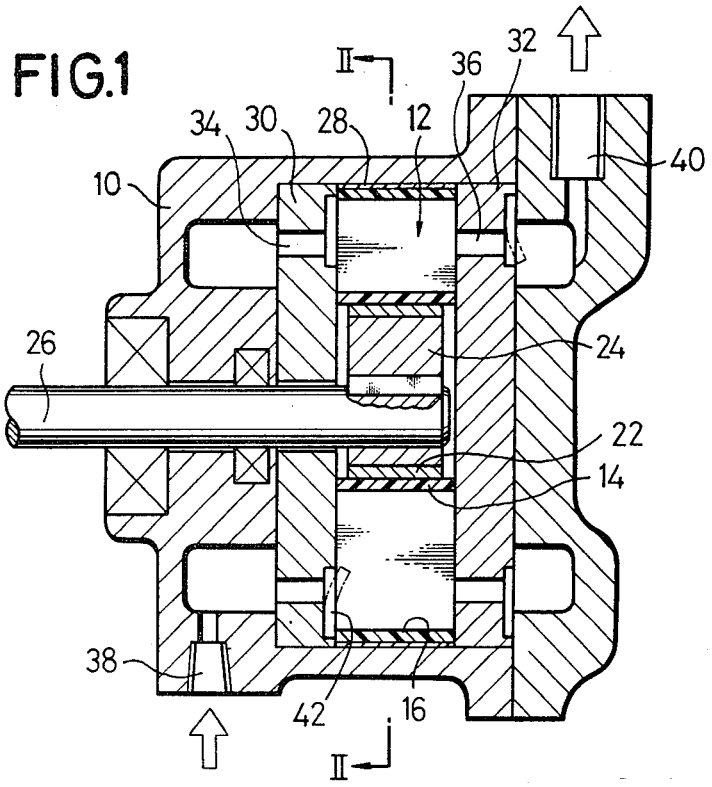
FIG. 1 is a longitudinally sectioned view of the volume pump in accordance with the present invention.
Figure 2:
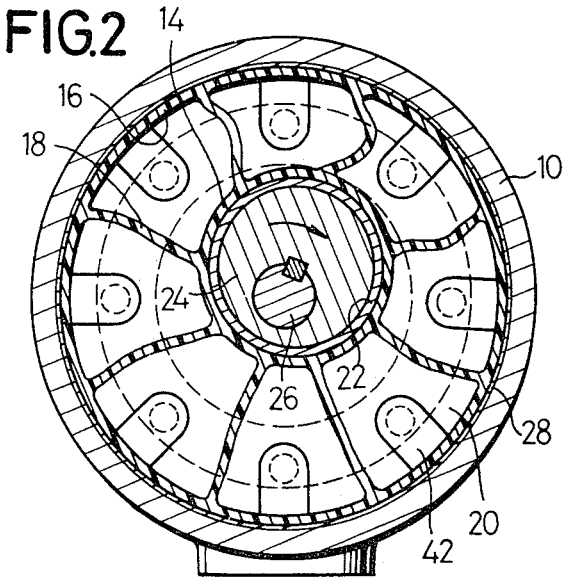
FIG. 2 is a cross sectional view taken along the line II—II of FIG. 1.

In FIGS. 1 and 2, the reference numeral 10 represents a pump casing in which a pump chamber 12 is received. The pump chamber 12 comprises an internal sleeve 14, an external sleeve 16 of the larger diameter than the internal sleeve 14 and concentrically arranged and a number of partitions 18 bridged between the internal sleeve 14 and the external sleeve 16 for providing a plurality of compartments 20 within the chamber, and these members are integrally formed of the synthetic material.

The internal sleeve 14 is supported by a bearing 22 in which an eccentric cam 24 is rotatably provided. To the eccentric cam 24 is connected a driving shaft 26 which upon rotation deflects the cam 24 to compress the compartments 20 successively along the direction of rotation of the cam 24 as shown by an arrow in FIG. 2. Between the periphery of the cylindrical pump chamber 12 and the inner wall of the pump casing 10 is selectively inserted a bush 28 which facilitates a placement and replacement of the pump chamber 12 into and from the pump casing 10.

Figure 3A:
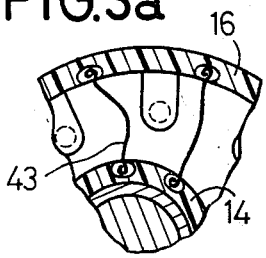
FIGS. 3*a* and 3*b* are fragmentarily enlarged cross sections of the compartment of the pump chamber of another embodiments according to the invention.
Figure 3B:
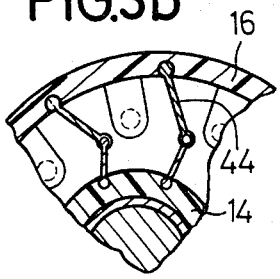

The open sides of the pump chamber 12 are closed by a side plate 30 and a side plate 32 respectively. The side plates 30 and 32 are provided with a number of suction ports 34 and delivery ports 36 respectively at the positions corresponding to each compartment. The suctions ports 34 are communicated with an inlet 38 of the pump casing whereas the delivery ports 36 are communicated with the outlet 40. The suction and delivery ports 34 and 36 are provided with check valves 42 in this embodiment. In the other embodiments as best shown in FIGS. 3*a* and 3*b*, the partitions 43 of pliable material or the partitions 44 of hard material but intermediately hinged are bridged between the internal sleeve 14 and the external sleeve 16.

Figure 4:
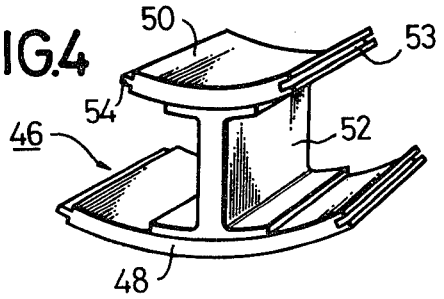
FIG. 4 is a fragmentarily enlarged perspective view of the pump chamber component.
Figure 5:
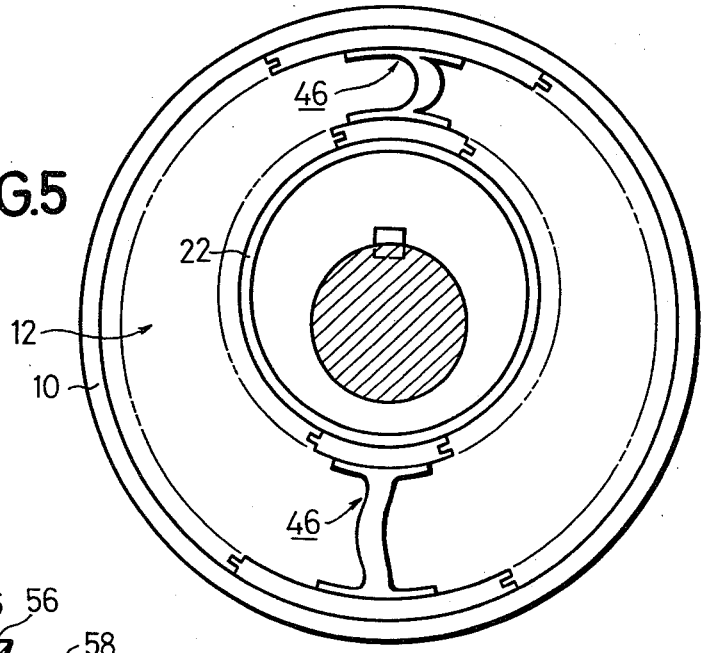
FIG. 5 is a lateral view of an assembled pump chamber unit.

In FIGS. 4 and 5, the pump chamber 12 is assembled by a plurality of preformed chamber components 46 which individually comprises an outer curved segment 48, an inner curved segment 50 having a larger curvature than that of the outer segment 48 and a flexible support member 52 bridged therebetween. The segments 48 and 50 are respectively provided with female fitting 53 at their one end portions and male fitting 54 at their opposite end portions. The components 46 are assembled by inserting the male fittings 54 into the female fittings 53 to provide a pump chamber 12 as shown in FIG. 5.

Figure 6:
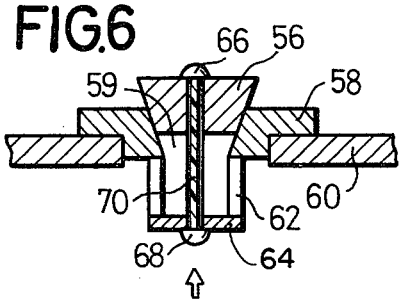
FIG. 6 is a sectional view of the valve to be used in the present invention.

As hereinbefore described, the check valve including a flap valve, a ball valve, a conical valve, a disc valve, a tube valve, an umbrella valve, a ring valve and the like may be applied to the pump chamber in accordance with the present invention. The valves as shown in FIGS. 6 to 9 are particularly designed for mounting to the pump chamber according to the present invention. In FIG. 6, a valve body 56 of a cone shape sits on a valve seat 58 having a central aperture 59 and secured to a base plate 60. The central aperture 59 at its bottom is communicated with a tube 62 which is provided at its circumference with openings for passing the fluid. The bottom end of the tube 62 is closed by a closure 64 which is connected to a valve body 56 through an elastic connection rod 70. The valve body 56 and the connection rod 70 may be formed integrally for convenience in the mass production.

Figure 7:
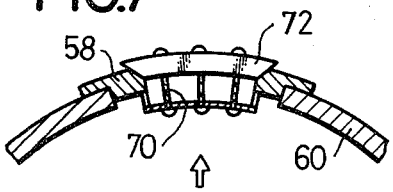
FIG. 7 is a sectional view of the valve of another embodiment according to the invention.
Figure 8:
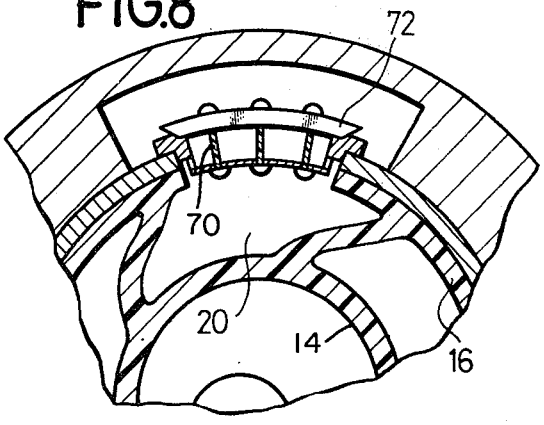
FIG. 8 is a pictorial view of the valve of FIG. 7 applied to the volume pump according to the present invention.
Figure 9:
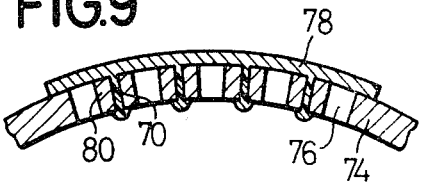
FIG. 9 is a fragmentarily enlarged sectional view of the valve of another embodiment which is directly attached to the external sleeve.

FIGS. 7 and 8 show another embodiment of the valve where a relatively elongated valve body 72 is provided with three connection rods 70 and mounted on the external sleeve 16. FIG. 9 illustrates a further embodiment of the valve when a curved chamber wall 74 is provided with a plurality of ports for passing the fluid and over the ports an elongated valve body 78 is placed and resiliently supported by the elastic connection rods 70 inserted into the spaces 80 formed between the ports 76.

Figure 10:
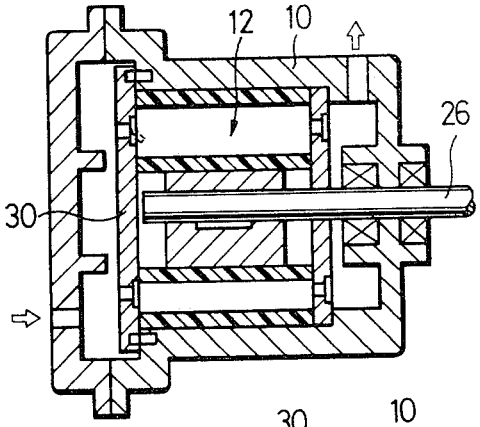
FIG. 10 is a longitudinally sectioned view of the pump showing side plates in engagement therewith.
Figure 11:
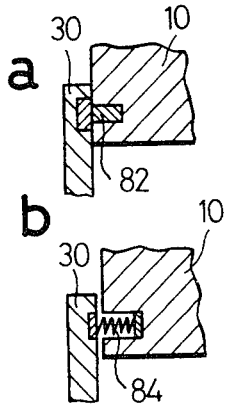
FIGS. 11 and 12 are fragmentarily enlarged sectional views showing engagements of the side plates with the pump chamber.

In FIG. 10, the side plate 30 on the suction side is releasably engaged with the cylindrical pump chamber 12 under the function of magnets 82 buried in the side plate 30 and the pump casing 10 or springs 84 mounted between the side plate 30 and the pump casing 10. When the pressure in the compartment is abnormally increased, the side plate 30 is urged outwardly to release the abnormal pressure for security of the operation.

Returning again to FIGS. 1 and 2, the liquid introduced from the inlet 38 of the pump casing 10 is sucked through the valve 42 provided in the suction port 34 into one of the compartments 20 which is most enlarged under the function of the deflective movement of the eccentric cam 24. The compartment filled with the fluid is then progressively compressed by a further deflection of the eccentric cam 24 and the fluid is delivered through the valve 42 provided in the delivery port 36 for the outlet 40.

FIGS. 16 to 26 illustrate further embodiments of the invention where the side plates are rotatably mounted.

Figure 16:
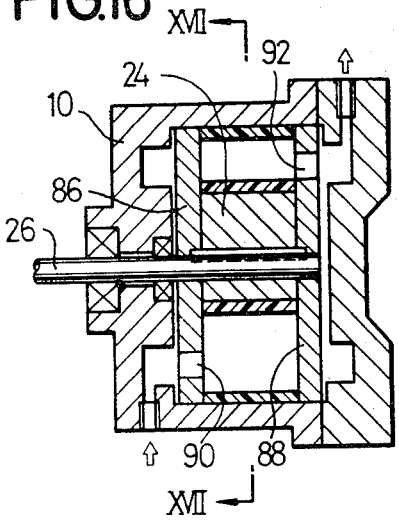
FIG. 16 is a longitudinally sectioned view of the volume pump of another embodiment according to the invention.
Figure 17:
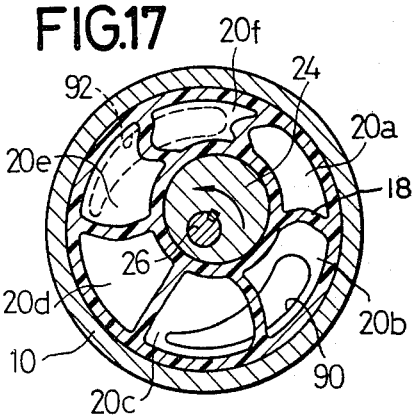
FIG. 17 is a cross sectional view taken along the line XVII—XVII of FIG. 16.
Figure 18:
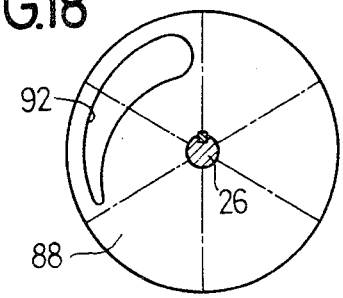
FIG. 18 is a front elevation of the side plate of FIG. 16.
Figure 19:
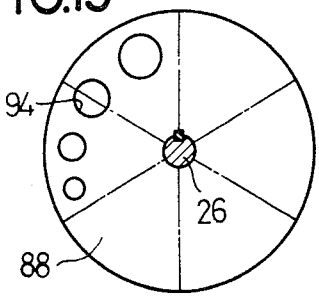
FIG. 19 is a front elevation of the side plate provided with another type of the port.
Figure 12:
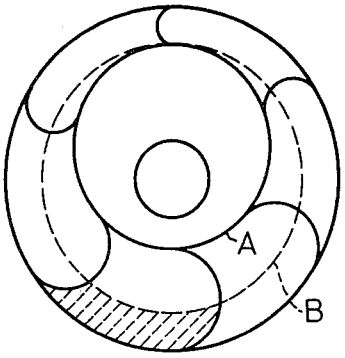
Figure 13:
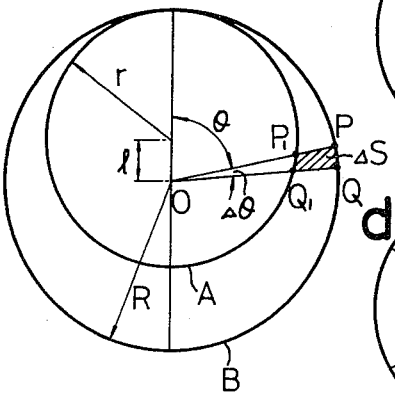
FIG. 13 is a pictorial view illustrating the volume change of the volume pump of FIG. 12.
Figure 14:
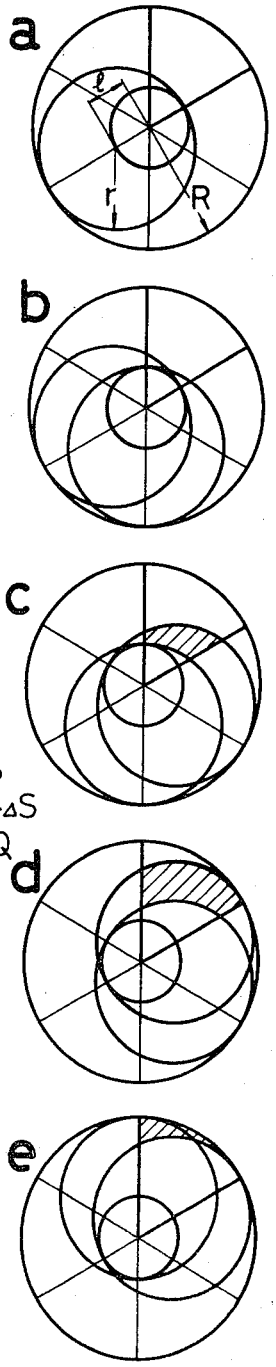
FIGS. 14*a* to 14*c* are pictorial views illustrative of the delivery processes of the volume pump according to the invention.
Figure 15:
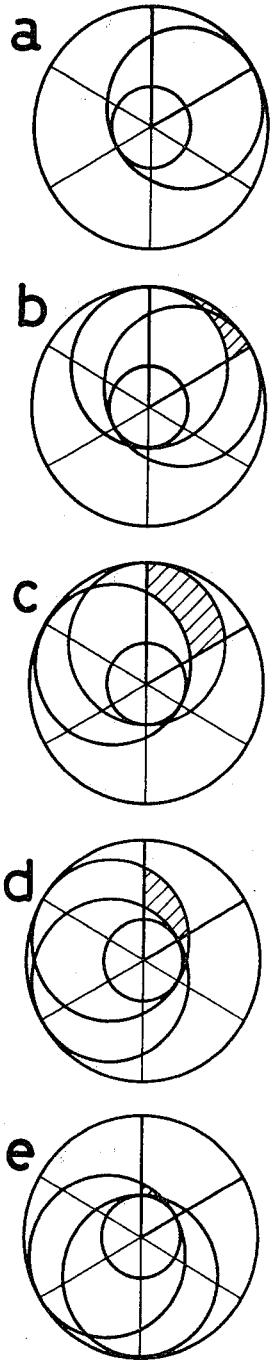
FIGS. 15*a* to 15*e* are pictorial views illustrative of the suction processes of the volume pump according to the invention.

In FIGS. 16 and 17, the pump chamber 12 is divided with six partitions 18 into six compartments 20 and provided with rotary side plates 86 and 88 which are secured to the driving shaft 26. The side plate 86 is provided with a fluid suction port 90 at the position corresponding to the compartments **20*b* and 20*c* adjacent in the reversed turning direction of the deflection cam 24 to the compartment 20*a* which is most compressed by the deflection cam 24 whereas the side plate 88 is provided with a fluid delivery port 92 at the position corresponding to the compartments 20*e* and 20*f* adjacent in the reversed turning direction of the deflection cam 24 to the compartment 20*d* which is most enlarged by the deflection cam 24 as best shown in FIG. 17. The size and shape of the ports 90 and 92 are determined in the manner hereinbefore described hereinbefore. In FIG. 19, the ports 90 and 92 are divided into a plurality of openings 94 of different sizes which lie over two adjoining compartments. Preferably the ports extend over a number of compartments determined by the relationship n-2/2 where n is greater than 2** and represents the total number of compartments in the pump chamber.

Figure 20:
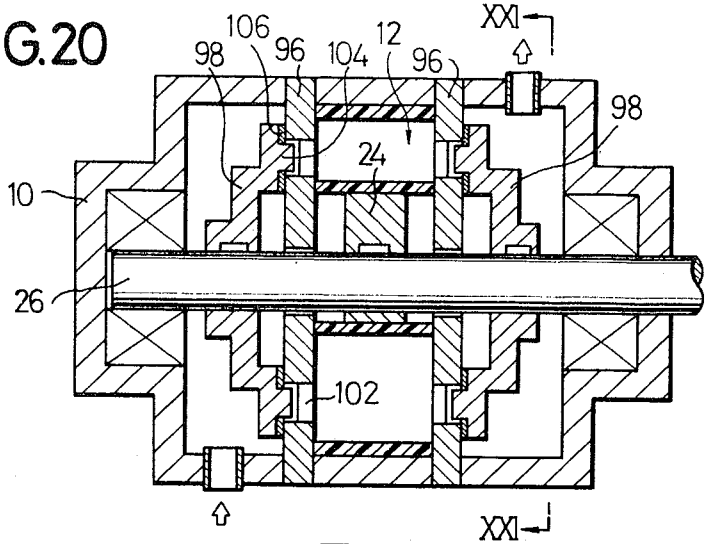
FIG. 20 is a longitudinally sectioned view of the volume pump of another embodiment according to the invention.
Figure 21:
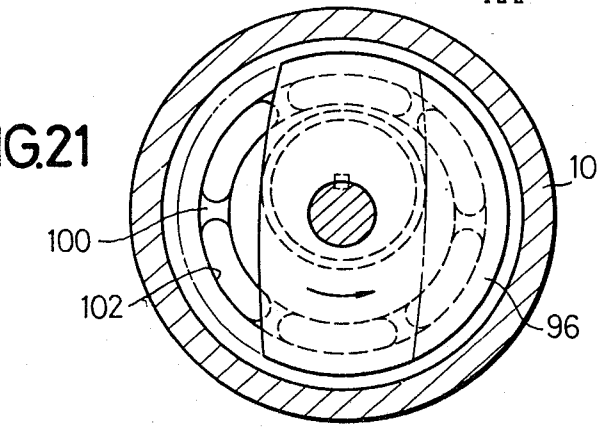
FIG. 21 is a cross section taken along the line XXI—XXI of FIG. 20.

FIGS. 20 and 21 illustrate another embodiment of the present invention where the pump chamber 12 at its open opposite sides are closed by double side plates, i.e. inner stationary side plates 96, 96 secured to the pump casing 10 and outer rotary side plate 98, 98 which are rotatably supported by the driving shaft 26. Individual stationary side plate 96 is provided with an annular groove 100 in which two or more ports 102 are opened at the positions corresponding to each compartment. While, individual rotary side plate 98 is provided at its one side with a rim 104 adapted to be fitted with sealing members 106 into the annular groove 100 provided in the stationary side plate 96. The rotary side plate 98 is symmetrically recessed as best shown in FIG. 21 so that the ports 102 in the stationary side plate 96 are successively opened upon rotation of the rotary plate 98 for effecting the desired pumping action including the suction and delivery processes. FIG. 26 illustrates an arrangement utilizing the embodiment of FIG. 20 and 21 whereby on attaining abnormally high pressures the rotary side plate 98 is automatically removed with its rim 104 from sealing engagement with stationary side plate 96 in groove 100 thereof.

Figure 22:
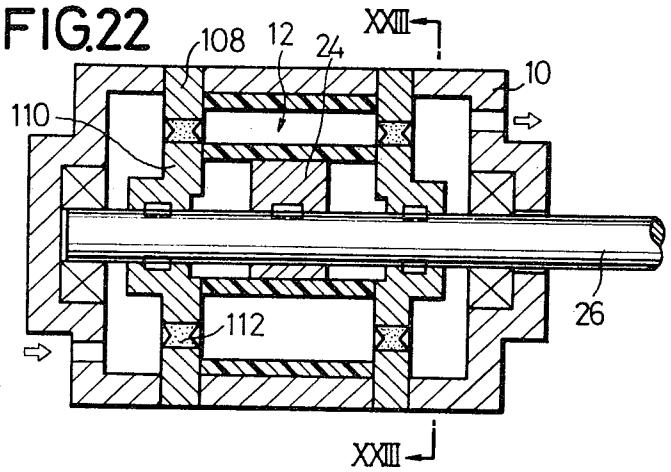
FIG. 22 is a longitudinally sectioned view of the volume pump of the other embodiment according to the invention.
Figure 23:
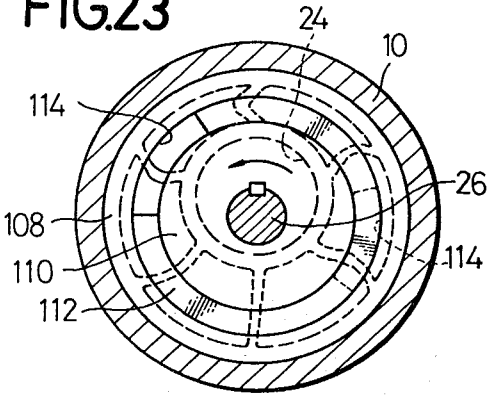
FIG. 23 is a cross sectional view taken along the line XXIII—XXIII of FIG. 22.

In FIGS. 22 and 23, the stationary side plate 108 is secured to the pump casing 10 and aligned therewith in the same plane, a rotary side plate 110 is rotatably supported by the driving shaft 26 through a rotary sealing ring 112. The sealing ring 112 on opposite sides of the pump chamber 12 are provided respectively with recesses 114 for successively opening each compartment upon rotation of the sealing ring 112 as best shown in FIG. 23. The port 114 on the suction side is provided in the little advancing position in relation to the turning direction of the cam 24 as shown by the solid lines in FIG. 23 while the port 114 on the delivery side is provided in the little delayed position in relation to the turning direction of the cam 24 as shown by the dotted lines.

In FIGS. 24 and 25, the pump chamber at its opposite open side are closed by deflection plates 116 which are mounted on the driving shaft 26 through a disc cam 118. On rotation of the driving shaft 26, the plate 116 with the disc cam 118 deflects to open successively each compartment as best shown in FIG. 25. The most deflected position "A" of the eccentric cam 24 is preferably 60° from the most deflected position "B" of the disc cam 118 as shown in FIG. 25. FIGS. 24 and 26 illustrate arrangement whereby on attaining abnormally high pressure, the high rotary side plate 116 in FIG. 24 and rotary side plate 98 in FIG. 26 may be urged against the pressure of spring 120 from engagement with the elements they are shown in engagement with in the respective Figures.

When an abnormal pressure is developed in each compartment, the rotary plate is moved to the right, as viewed in these Figures, against the bias of spring 120 to relieve abnormal pressures, when they occur, for safety.

FIGS. 27 to 33 illustrate another embodiments of the deflection means applicable to the present invention. In FIGS. 27 and 28, the external sleeve 16 of the pump chamber 12 is formed of magnetic substance and surrounded at a selected distance by an alternating magnetic field generator 128 in which a number of magnetic poles 130 are radially arranged. In operation, a predetermined voltage is applied to the alternating field generator to draw intermittently the corresponding part of the outer sleeve of the pump chamber in the radial direction thereby to vary the volume of each compartment successively. The shaft and eccentric cam will not be rotated because they are isolated from the magnetic fields generated between the alternating field generator and the outer shell 16. Alternately, the internal sleeve 14 has embedded therein a plurality of magnetic substances 132 positioned about the circumference of the pump chamber. The alternating field generator 128 is arranged to intermittently draw, when a predetermined voltage is applied to the generator, the corresponding part of the internal sleeve thereby to again vary the volume of each compartment successively as shown in FIG. 30.

In FIG. 31 the driving shaft 26 for supporting the eccentric cam 24 is extended at its opposite ends outwardly and disposed within the alternating field generator 128 which includes a number of radially arranged magnetic poles 130. The extended portions of the shaft 26 are provided with magnetic substances and because the shaft is proximate the magnetic poles and within field generator 128, when a predetermined alternating voltage is applied, the shaft 26 together with the eccentric cam 24 will be caused to rotate thereby to compress each compartment of the pump chamber successively. Alternately, as in FIG. 32, the side plates 133 have embedded therein magnetic substances 134 and are secured to the driving shaft 26 which supports the eccentric cam 24. The magnetic substances 134 are in confronting relation to the poles of the alternating field generator 136 provided on an inner wall of the pump casing 10. With this arrangement when an alternating voltage is applied to the alternating field generator, the side plates 133 will revolve thereby also revolving shaft 26 and cam 24.

When a predetermined voltage is applied to the generator, the side plates 133 are deflected together with the driving shaft 26 as well as the cam 24 mounted thereon thereby to compress each compartment successively.

Figure 33:
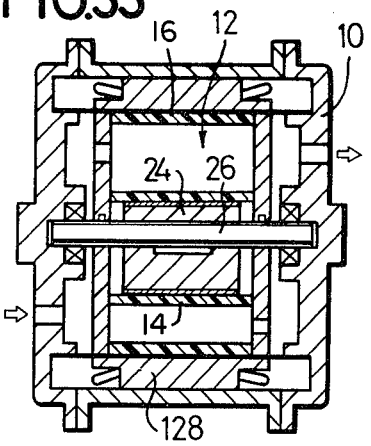
FIG. 33 is a longitudinally sectioned view of the pump where the eccentric cam per se is buried with magnetic substances and deflected under the influence of the magnetic field.

In FIG. 33, the magnetic substances are embedded in the cam 24 which is in turn surrounded at a predetermined distance therefrom by the alternating field generator 128. When a predetermined voltage is applied to the generator, the cam containing the magnetic substances rotates under the function of the magnetic field to deflect and compress each compartment successively.

Figure 34:
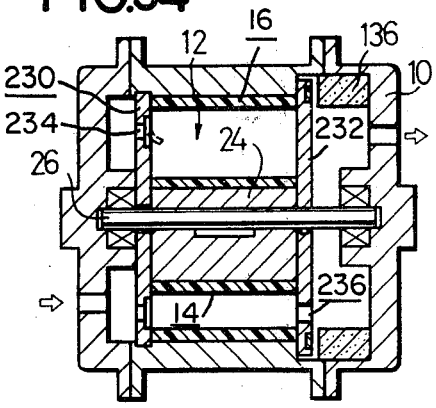
FIG. 34 is a longitudinally sectioned view of the volume pump of another embodiment provided with a stationary side plate and a rotary side plate.
Figure 35:
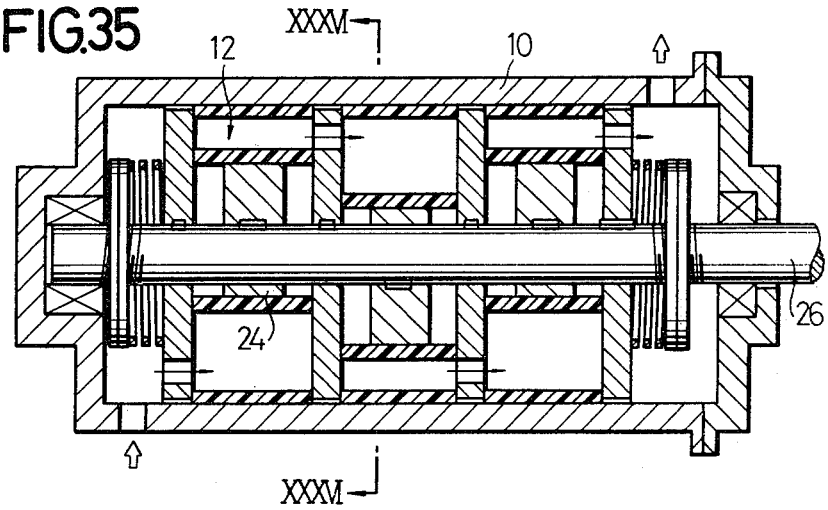
FIG. 35 is a longitudinally sectioned view of the multistage pump according to the invention.
Figure 36:
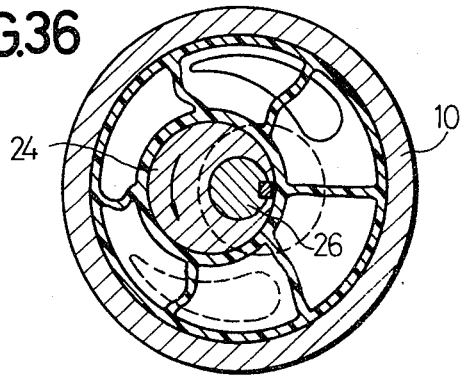
FIG. 36 is a cross section taken along the line XXXVI—XXXVI of FIG. 35.

As hereinbefore described, two or more pump chambers constituted in accordance with the present invention may be arranged on a common driving shaft to provide a multistage pump system. For example, in FIGS. 35 and 36, three pump chambers of the types as shown in FIGS. 16 and 17 are arranged on the common driving shaft 26 in a juxtapositional relation. In FIG. 34, a device similar to that of FIG. 32 is shown except that only one plate can rotate while the other is fixed. For example, the pump chamber may have a stationary side plate 230 on one open side for inlet through a port 234 and a rotary side plate 232 on the opposite open side as best shown in FIG. 34. The rotary side plate 232 is provided with a fluid outlet port 236 which during rotation of the deflecting means 24 communicates with the compartment of least volume. The number of ports in the rotary side plate (similar to those shown in FIG. 19) can vary being determined by the relationship (n-2)/2 or (n-1)/2 where n is greater than 2 and represents the number of compartments in the pump chamber. While certain preferred embodiments of the invention have been illustrated by way of example in the drawings and particularly described, it will be understood that various modifications may be made in the apparatus and constructions and that the invention is no way limited to the embodiments shown.

What we claim is:

1. A volume pump having a pump chamber formed between inner and outer concentrically arranged sleeves, a plurality of generally radially directed yieldable sheet-like partitions spaced circumferentially and extending between and engaging said inner and outer sleeves, said partitions forming with said inner and outer sleeves, respectively, a plurality of compartments each extending in radial direction the full extent between said sleeves, separate side plates for closing opposite ends of said compartments defined by said sleeves and said generally radially directed partitions, one of said side plates being stationary and the other of said side plates being rotatable, one of said plates having suction inlet means for the compartments formed therein and the other of said side plate having delivery outlet means for the compartments formed therein and rotatable deflection means within said inner sleeve to successively change the volume of said compartments.

2. A volume pump as claimed in claim 1, wherein the rotary side plate has a plurality of openings of different sizes.

3. A volume pump as claimed in claim 1, wherein the rotary side plate is provided with ports which extend over a number of compartments determined by the relationship $n-2/2$ where n is greater than 2 and represents the total number of compartments in the pump chamber.

4. A volume pump as claimed in claim 1, wherein the rotary side plate is provided with ports which extend over a number of compartments determined by the relationship $n-1/2$ where n is greater than 2 and represents the total number of compartments in the pump chamber.

* * * * *